US009085866B2

(12) United States Patent
Schnaars, Sr. et al.

(10) Patent No.: US 9,085,866 B2
(45) Date of Patent: Jul. 21, 2015

(54) FLOOD WALL PROTECTION SYSTEM

(75) Inventors: Daniel R. Schnaars, Sr., Lafayette, LA (US); Everett Leslie Waid, Jr., Ft Myers, FL (US); Jean André Beard, Lafayette, LA (US)

(73) Assignee: AMERIGLOBE, LLC, Lafayette, LA (US)

( * ) Notice: Subject to any disclaimer, the term of this patent is extended or adjusted under 35 U.S.C. 154(b) by 225 days.

(21) Appl. No.: 13/422,593

(22) Filed: Mar. 16, 2012

(65) Prior Publication Data

US 2012/0230766 A1 Sep. 13, 2012

Related U.S. Application Data

(63) Continuation-in-part of application No. 13/364,114, filed on Feb. 1, 2012, now Pat. No. 8,672,585.

(60) Provisional application No. 61/438,313, filed on Feb. 1, 2011, provisional application No. 61/453,402, filed on Mar. 16, 2011.

(51) Int. Cl.
*E02B 3/10* (2006.01)
*E02D 29/02* (2006.01)

(52) U.S. Cl.
CPC ..... *E02B 3/108* (2013.01); *E02D 29/0291* (2013.01)

(58) Field of Classification Search
CPC ..... E02D 29/0291; E02B 3/108
USPC ..... 405/107, 110, 111, 114, 115, 284
See application file for complete search history.

(56) References Cited

U.S. PATENT DOCUMENTS

| | | | |
|---|---|---|---|
| 3,213,628 | A | 10/1965 | Serota |
| 4,692,060 | A | 9/1987 | Jackson, III |
| 4,807,299 | A | 2/1989 | Nattrass et al. |
| 5,040,919 | A | 8/1991 | Hendrix |
| 5,584,599 | A | 12/1996 | Knittel |
| 5,632,573 | A | 5/1997 | Baker |
| 5,771,665 | A | 6/1998 | Nelson et al. |
| 6,164,870 | A | 12/2000 | Baruh |
| 6,390,154 | B1 | 5/2002 | Hall |
| 6,551,025 | B2 | 4/2003 | Dery |
| 6,619,884 | B2 | 9/2003 | Davis et al. |

(Continued)

FOREIGN PATENT DOCUMENTS

| | | | | |
|---|---|---|---|---|
| AT | 411913 | * | 6/2004 | ..... E02B 3/10 |
| KR | 20-0268953 | | 3/2002 | |

*Primary Examiner* — Frederick L Lagman

(74) *Attorney, Agent, or Firm* — Garvey, Smith, Nehrbass & North, L.L.C.; Gregory C. Smith; Julia M. FitzPatrick

(57) ABSTRACT

A flood wall system and method of constructing same, including providing a first main panel section; attaching sleeves to each side of a main panel prior to configuring the final chamber; providing two sleeves of fabric at the upper opening of each chamber for supporting the chambers while they are filled with materials such as sand; providing a series of chambers sewn together to define a continuous cellular wall; the final chamber having a horizontal height which is two feet (0.6 m) longer than the vertical height further having a front toe portion one foot (0.3 m) in height; filling each chamber with a quantity of material, such as sand; on each end of a completed chain of chambers, further comprising a set of loops or ties so that a chain of chambers is capable of being tied to other chains of chambers to define the continuous flood wall system.

3 Claims, 12 Drawing Sheets

(56) References Cited

U.S. PATENT DOCUMENTS

| | | | | |
|---|---|---|---|---|
| 7,431,534 | B2 | 10/2008 | Harbeck | |
| 7,445,403 | B2 * | 11/2008 | Williams et al. | 405/107 |
| 7,449,105 | B2 | 11/2008 | Hastings | |
| 7,491,016 | B2 | 2/2009 | Baruh | |
| 7,591,611 | B2 | 9/2009 | Arellanes et al. | |
| 7,651,298 | B2 | 1/2010 | Boudreaux, Jr. | |
| 8,235,631 | B2 * | 8/2012 | Adams et al. | 405/284 |
| 2007/0140598 | A1 | 6/2007 | McGillick et al. | |
| 2007/0154264 | A1 * | 7/2007 | Baruh | 405/110 |
| 2009/0103981 | A1 * | 4/2009 | Tagini | 405/114 |
| 2009/0274519 | A1 * | 11/2009 | Shaw | 405/107 |
| 2010/0047019 | A1 * | 2/2010 | Hvezda et al. | 405/114 |
| 2011/0103900 | A1 | 5/2011 | Adams et al. | |
| 2012/0195687 | A1 | 8/2012 | Beard et al. | |
| 2013/0094905 | A1 * | 4/2013 | Schnaars et al. | 405/114 |

* cited by examiner

Dimensional Details

A – Vertical height

B – Base length (always equal to A+24 in. (0.61 m)

C – Height of front face

D – Length of Diagonal face

E – Length of filling Mouth

F – Width of Main Panel and width of Filling Mouth

G – Main Panel, It is equal to A+B+C+D

A = 72 in. (1.83m)

B = 96 in. (2.44m)

C = 12 in. (0.30m)

D = 84.6 in. (2.15m)

E = 36 in. (0.91m)

F = 32 in. (0.81m)

FINAL PACKING

- ADD COVER BAG
- STRAP TO PALLET
- ADD TAG INDICATING TRAP BAG STYLE THAT IS 6 FEET TALL (1.8 m)

FLOOD WALL PROTECTION SYSTEM

CROSS-REFERENCE TO RELATED APPLICATIONS

In the US, this application is a continuation-in-part of U.S. patent application Ser. No. 13/364,114, filed 1 Feb. 2012, entitled "FLOOD WALL PROTECTION SYSTEM", by the same inventors, incorporated by reference.

This application claims priority of U.S. Provisional Patent Application, Ser. No. 61/453,402, filed 16 Mar. 2011, entitled "FLOOD WALL PROTECTION SYSTEM", by the same inventors, and incorporated herein by reference.

This application is related to U.S. Provisional Patent Application, Ser. No. 61/438,313, filed 1 Feb. 2011, entitled "FLOOD WALL PROTECTION SYSTEM," by the same inventors, incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to temporary flood walls. More particularly, the present invention relates to a system which utilizes a continuous sleeve that is fitted into each connecting wall. This sleeve provides a stiff and straight support for the entire length of the connecting walls by use of a metal rod which is threaded through the sleeve and supported by the metal rails of the sled or any other hanging device that may be used. The present invention also describes a filling device that allows heavy equipment such as front end loaders to efficiently fill the cellular barrier will no loss of fill materials while providing a smooth even, level top to the filled barrier wall.

2. General Background of the Invention

The art of building temporary flood walls is well known. The most commonly known method is to fill small bags full of sand and stacking them up in a pyramid fashion to hold back flood waters. These small bags weighed between 50 and 100 pounds (between 23 and 45 kg). Building flood walls with this method involves a lot of labor and time.

It is also well known in the art that once flexible fabrics are formed into continuous cellular walls, and filled with sand and dirt, it forms a solid barrier against water. However, filling these flexible containers on banks along rivers and shore lines is not an easy task. The flexible walls must be properly supported until the containers are filled. One such method accomplishes this by using a large metal sled that supports each portion of the cellular wall as it is filled. The sled then pulled along a horizontal line until it clears the filled cell and new unfilled cells are opened and supported under the sled waiting to be filled.

Existing methods support each cell's corner with a special plastic hangar that is not readily available and is therefore expensive. These plastic hangars can only be used a single time. As two hangars are used every two feet (0.6 m) of the wall, the costs of these special parts add up over the course of each mile of wall that is placed. Further, with only the corners supported, there is noticeable sagging of the cellular walls as each cell is filled. This sagging creates uneven tensions on the four holders. The uneven tension can often overload individual hangars and cause them to fail during the movement of the sled.

The individual cells of the wall can be filled with up to 7,000 pounds (3,175 kg) of sand or dirt. After filling, the sled moves horizontally. The hangars must slide along metal rails until they clear the sled. Under this tremendous weight, these hangars can fail and cause the cells to drop from the sled prematurely.

Other methods involve simply piling truckloads of sand and dirt on top of levees. But while this method is fast, it is prone to washouts as the sand and dirt is uncontained against the flow of water.

Still another method uses open top bulk bags with wooden frames inside them which are bolted together in a cellular fashion to create vertical long walls that are then filled with sand and dirt. It is a fairly fast method for constructing walls but has the expense of the wood and is limited to vertical walls that can be pushed over by fast moving flood waters or collapsed from beneath as the flood waters hollow out the ground beneath them.

Still another method uses specially shaped bags that have triangular shaped sides. These bags are delivered using a large sled device that makes filling easier and faster than the methods listed above. However, this sled device relies on a bag support method that requires special parts to support each bag by its four corners that can be expensive and unreliable. Further the triangular shaped front of the containers are often unfilled due to its pointed toe. Due to the wave action of the flood waters, the sand and dirt can move after placement and cause some loss of control over its shape. And, just as the square bags can be hollowed out from below, so can this triangular faced design.

In short, each of the existing methods of flood control that utilize flexible materials still have shortcomings that need to be addressed.

SUMMARY OF THE PRESENT INVENTION

It is the purpose of this invention to address all of these various shortcomings in a unique and straightforward manner. What is provided is a system and method of constructing any desired length or height linear cellular chain for use as a protective wall system, made of flexible materials, comprising the following providing an end panel made of flexible materials; each end panel shaped such that it will provide a specified shape to a main panel; the specified shape shall have a vertical wall that will define the final height of each cell, a bottom wall that is longer than the height of the vertical wall, a second vertical wall that is sized to allow for the final wall that will slope upward to have at least a 45 degree angle up to an opening for filling that is defined by the top of the vertical wall and the top of the sloped wall; providing a sleeve of similar flexible materials at the top of each end panel that are essentially the full length of the defined opening and tall enough to accept a support rod for filling; providing a main panel section made of essentially the same flexible material that equals the length of the enclosed dimensions of a completed cell by sewing one edge of the main panel along the edge of the end panel, starting at the top of the vertical side and sewing around the entire perimeter, ending at the top of the sloped side; repeating these steps by adding additional end panels and main panels until the desired length of chain is achieved. The chain is then positioned onto a sled which accommodates a plurality of unfilled bags which move along the sled and are positioned beneath a hopper. The hopper fills the plurality of bag simultaneously, and after being filled, the bags are rolled from the sled and are in position to serve as a portion of the barrier together with other plurality of bags to define the overall chain.

This invention still uses flexible fabric to create a continuous cellular wall as does the second two methods above. However, it requires no wood nor any special and unreliable parts to hold it up during the filling process. It has no pointed toes that are difficult to fill. But most importantly, it resolves the problem caused by the flood hollowing out the ground beneath the barrier. By eliminating this particular problem, this invention provides far more security to any property being protected by this barrier wall than any previous method involving flexible fabrics.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 15A illustrates respectively a series of unfilled bulk bags ready to be rolled onto the sled portion, while

FIG. 16A illustrates a plurality of partially filled bags positioned along the sled portion, in the process of being filled from the hopper portion of the present invention; while

FIG. 17 illustrates a side view of the filled bags as seen in FIG. 16B, with the filled bags ready to move off of the sled portion of the present invention;

FIG. 18 illustrates the series of filled bags removed from the sled portion and illustrate a representative sample of the filled bags with will be in position to serve as a portion of a flood barrier.

DETAILED DESCRIPTION OF THE INVENTION

Figure 1:
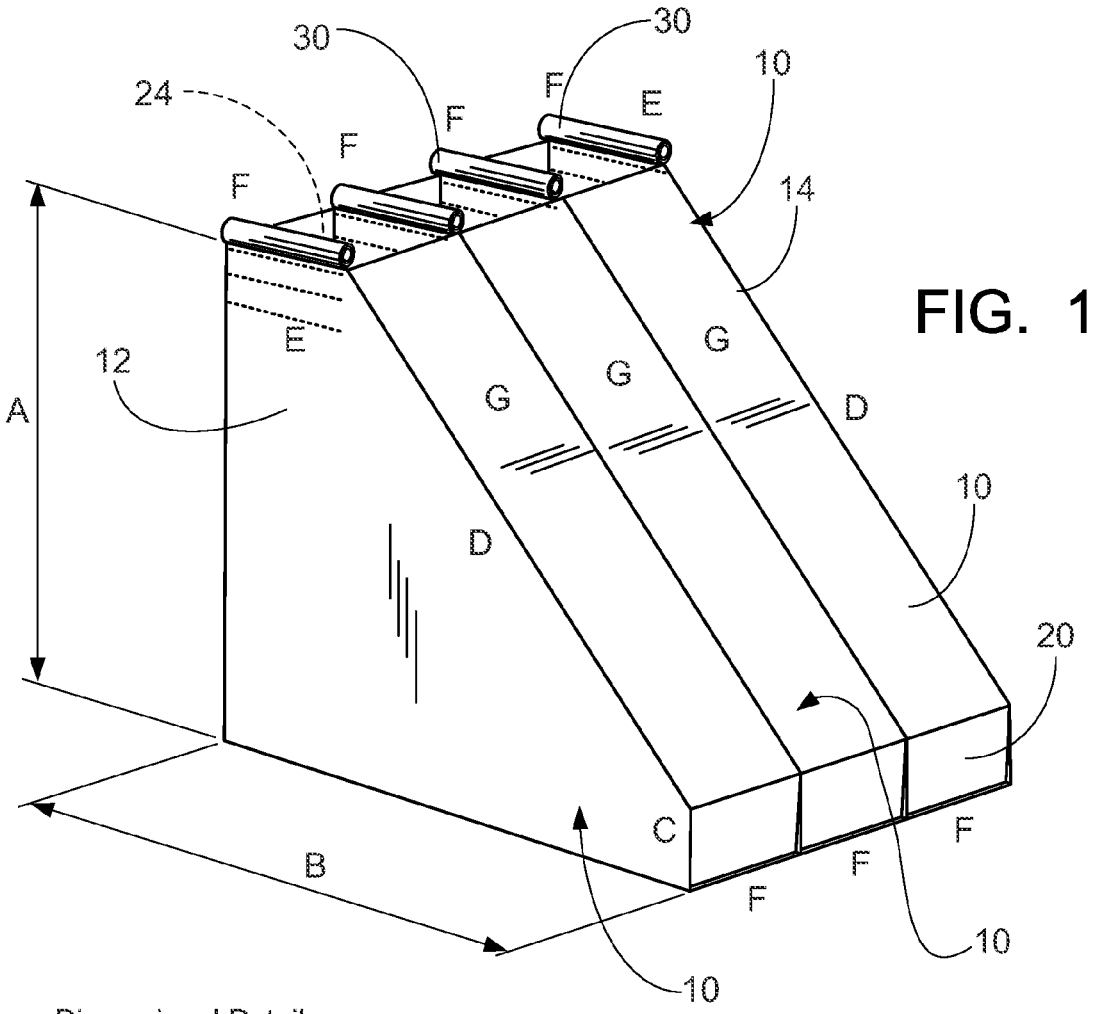
FIG. 1 illustrates an overall view of the preferred embodiment in the bags or chambers used in the system of the present invention, including preferred dimensions of the bags.

FIGS. 1 through 19 illustrate the TrapBag® system and method the present invention of filling a continuing series of bags or chambers to ultimately define a barrier wall.

Prior to a discussion of the drawing figures, it should be understood that this invention replaces the method of support as seen in the prior art with a unique sleeve support system. Instead of four individual plastic hangars that can break and allow connecting walls to sag and misshape, this invention uses a continuous sleeve that is fitted into each connecting wall. This sleeve provides a stiff and straight support for the entire length of the connecting walls by use of a metal rod which is threaded through the sleeve and supported by the metal rails of the sled or any other hanging device that may be used.

This complete support of the connecting wall completely eliminates the sagging during the filling process. It also spreads out the weight of the sand and dirt during the sled movement. The two continuous sleeves maintain their spacing during the movement of the sled and slide evenly along the metal rail supports without failure.

As the cells are filled and cleared from the sled, the metal hanging bars can be easily slid out of the sleeves and re-used by inserting them in the sleeves of unfilled cells. Each metal bar can be re-used hundreds of times making their cost negligible.

This sleeve and bar method can be used on barriers of almost any design. It can be used on both straight sided containers such as bulk bags or it can be used on slope sided containers such as discussed in this invention.

A second feature of this invention is the elimination of the pointed toe that often cannot be filled. As traditional slant sided containers are filled, the angle of repose and the coefficient of friction of the various materials used to fill them, can often prevent the fill materials from reaching the end of the toe. This invention simply eliminates this problem by designing a blunted end of the container and keeping the non-vertical side wall at or near a 45 degree angle.

A third feature of this invention is the use of the 45 degree slanted wall on one side of the flood wall. By sloping the wall facing away from the rising water, the sloped wall adds triangular force to prevent wall collapse. Bags with simple vertical walls are prone to tipping over from the force of the water.

By adding the slope opposite the force of the water, the wall has greater resistance to tipping over than even a similarly based container with vertical walls. As a vertical wall begins to tip, the weight of wall that immediately crosses the vertical position becomes encouragement for the wall to tip over. With a sloped side, there will be no weight crossing the vertical line and encouraging the container to tip over. Further, the center of gravity for the entire container is moved toward the force of the water creating even further resistance to tipping over.

However, the slope of the container can also be placed facing the water. Due to the shape of the container, there is a greater percentage of weight in the bottom half of the container. Further, when the sloped side is facing the water, it provides a few different advantages.

As the water rises on the sloped side, the weight of the water that is above the toe is added to the weight of the fill material giving this system additional holding strength.

Also, when operational space is important on the non-water side, having the vertical side away from the water provides a more visible barrier to traffic and equipment. This visibility reduces accidental damage to the barrier walls.

Further, the sloped side deflects any wave action upward in a harmless direction. When wave action hits the vertical side, some of the wave action is directed downward where it can be involved in hollowing out the base under the container.

A fourth feature is an optional wave protector. We can add a piece of fabric all along the bottom edge of the side of the bag that is facing the water. This fabric can be partially buried into the ground in front of the cells. Moving water cannot drive through this barrier and undercut the support of the ground from under the bags.

This was an important failure of the Hesco Barriers during the BP oil spill. Rolling waves will be stopped by the fabric barrier and safely run off away from the bag.

Turning now to the drawing Figures, FIGS. 1-12 illustrate views of the construction of the bulk bags used in the system of the present invention, while FIGS. 13 through 18 illustrate views of the sled and hopper machinery utilized in loading sand or other material into the bags, and the method of filling the plurality of bulk bags during the process.

Although there will be a discussion of the overall invention, referred to as the TrapBag®, the first discussion will relate to the construction of the individual bulk bags used as part of the present invention, as illustrated in the drawing FIGS. 1-12.

FIG. 1 illustrates a plurality of the chambers 10 engaged to one another with the dimensions of each chamber 10 set forth in the preferred embodiment. For purposes of discussion chambers 10 may also be referred to as "bags" or "cells" herein. As illustrated the chambers 10 include a pair of sidewalls 12,14, which are basically triangular in shape, having a floor portion 16, a slanted forward face 18, terminating in a vertical toe portion 20, and a rear wall 22, all of which are secured together via stitching or the like to define a container space 24, therewithin for receiving material, such as dirt, sand, or other material. As seen further, the upper end 26 of the chamber 10 has an open end 28, into which the materials are inserted into the space 24. There is further provided a pair of fabric channels 30 for receiving rods during filling, as will be discussed in further Figures. In FIG. 1, a series of three bags 10 are placed together into a single, continuous unit in a manner to be discussed further. There is further included the preferred dimensions of the bags used in the present invention.

Figure 2:
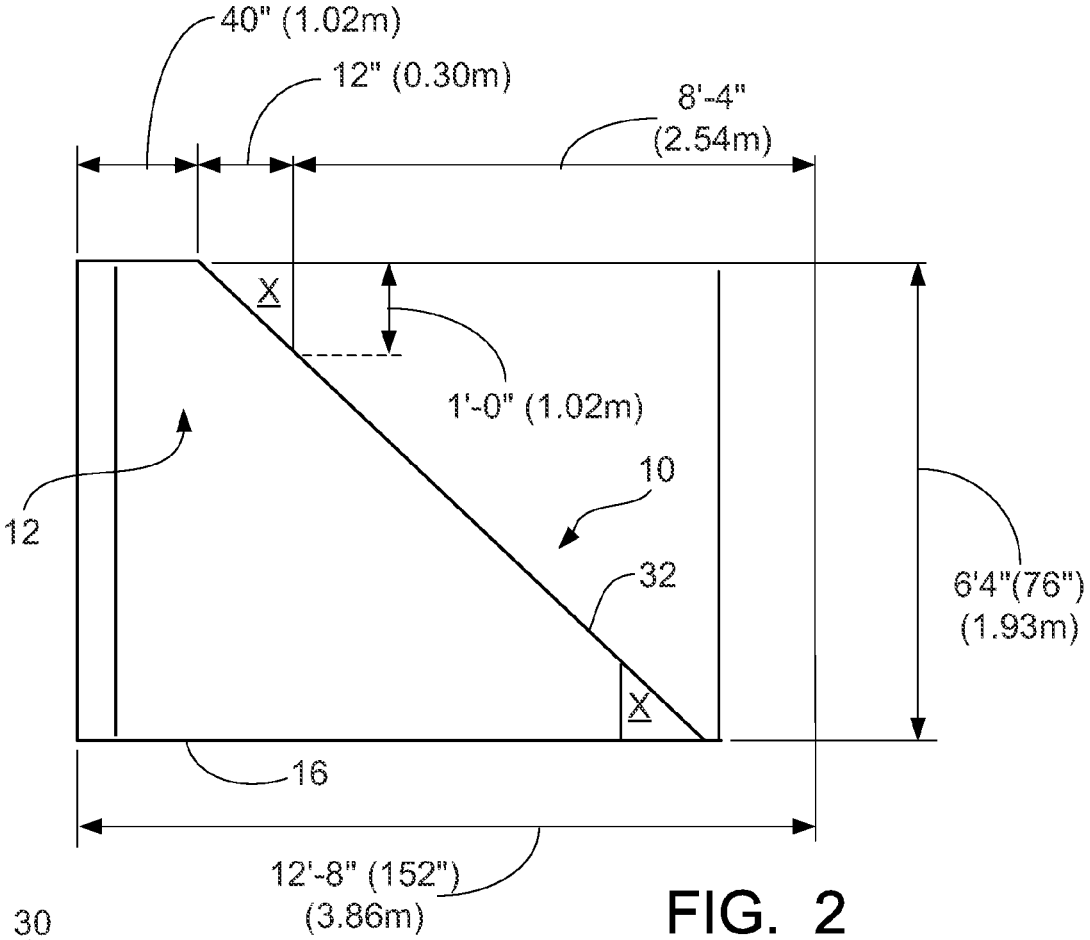
FIG. 2 illustrates the construction of the side panels in the system of the present invention.

FIG. 2 illustrates the construction of the side panels 12 by configuring two sides 12 from a single length of fabric cut along the diagonal line 32 as illustrated. The various preferred dimensions of the side panels 12 are shown in the FIG. 2.

Figure 3:
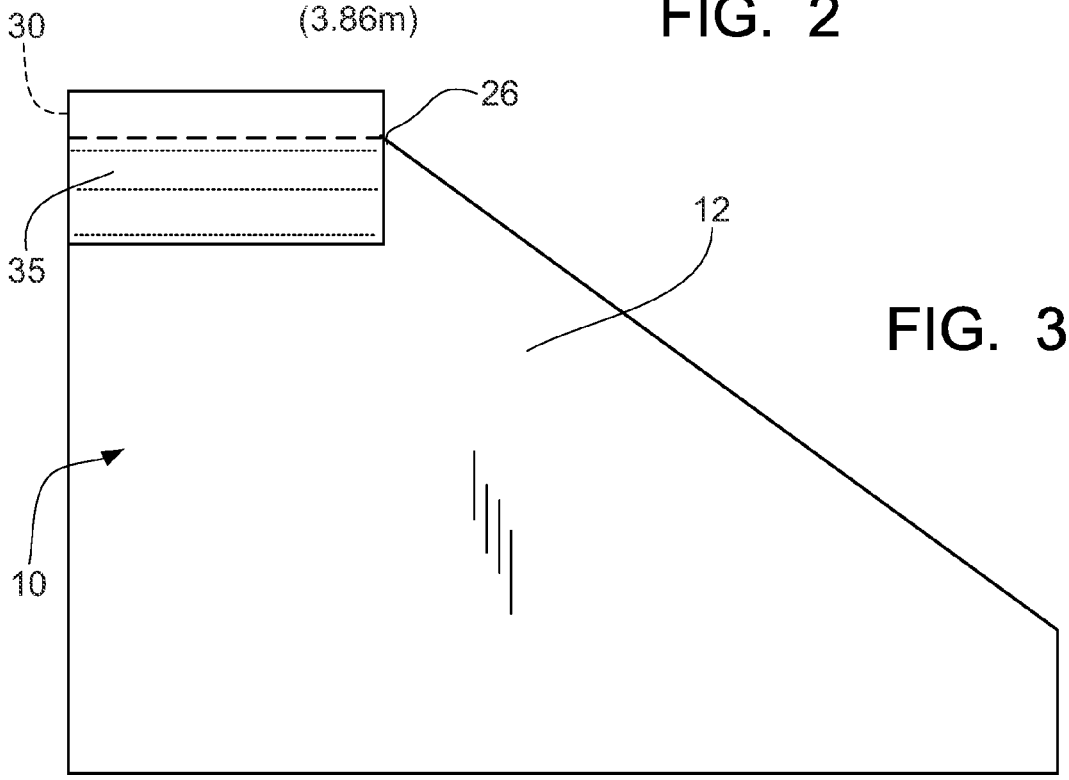
FIG. 3 illustrates the sleeve construction and attachment in the system of the present invention.

FIG. 3 illustrates the sleeve construction and the manner of attachment as described in the drawing Figure. As illustrated, each of the side panels 12 include a section of fabric 35 stitched or sewn to the upper end 26 of each of the panels 12, in an overlapping fashion, to define the upper channel 30, as was discussed in regard to FIG. 1. Again the function of these channels 30 will be discussed further.

Figure 4:
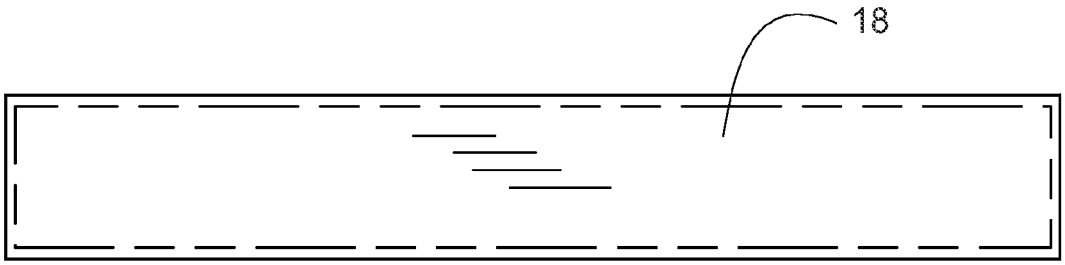
FIG. 4 illustrates the main panel construction in the system of the present invention.

FIG. 4 illustrates the construction of each of the front panels 18 that will be part of each of the chamber 10, in the proper length and width as described.

Figure 5:
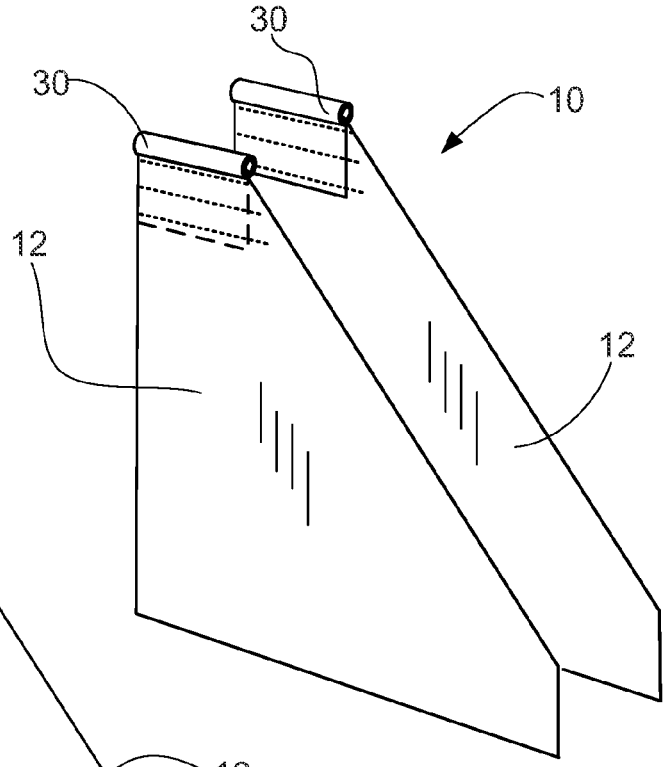
FIG. 5 illustrates the addition of sleeves to the side panels in the system of the present invention.

As seen in FIG. 5, each of the side walls 12 are fitted with the section of fabric 35 to define the upper channels 30 before the side walls 12 are engaged together to define the chamber 10. FIG. 5 illustrates the procedure for adding the sleeves to the side panels in the construction.

Figure 6:
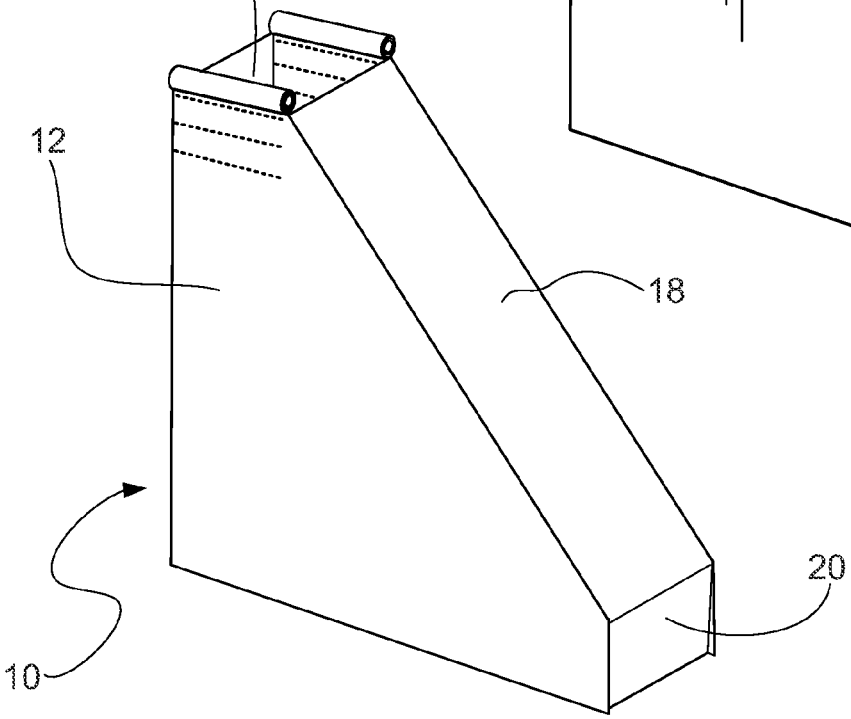
FIG. 6 illustrates the sewing of one main panel to two side panels.

FIG. 6 illustrates the sewing of the front panel 18 and the rear panel 22 to the two side panels 12, to define the completed chamber 10.

Figure 7:
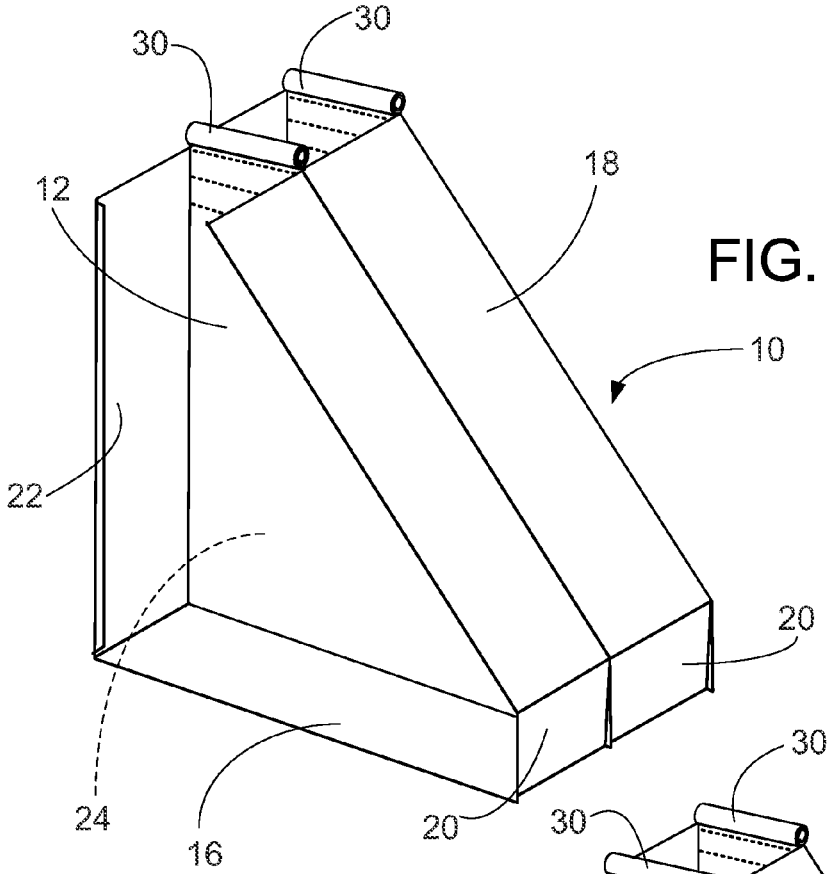
FIG. 7 illustrates adding one main panel to one completed chamber.

FIG. 7 illustrates a first completed chamber 10 being secured to a second chamber 10 and the procedure in adding one front panel 18 to one completed chamber 10 as illustrated. As seen in the FIG. 7, the second side 12 of second chamber 18 has not yet been set in place.

Figure 8:
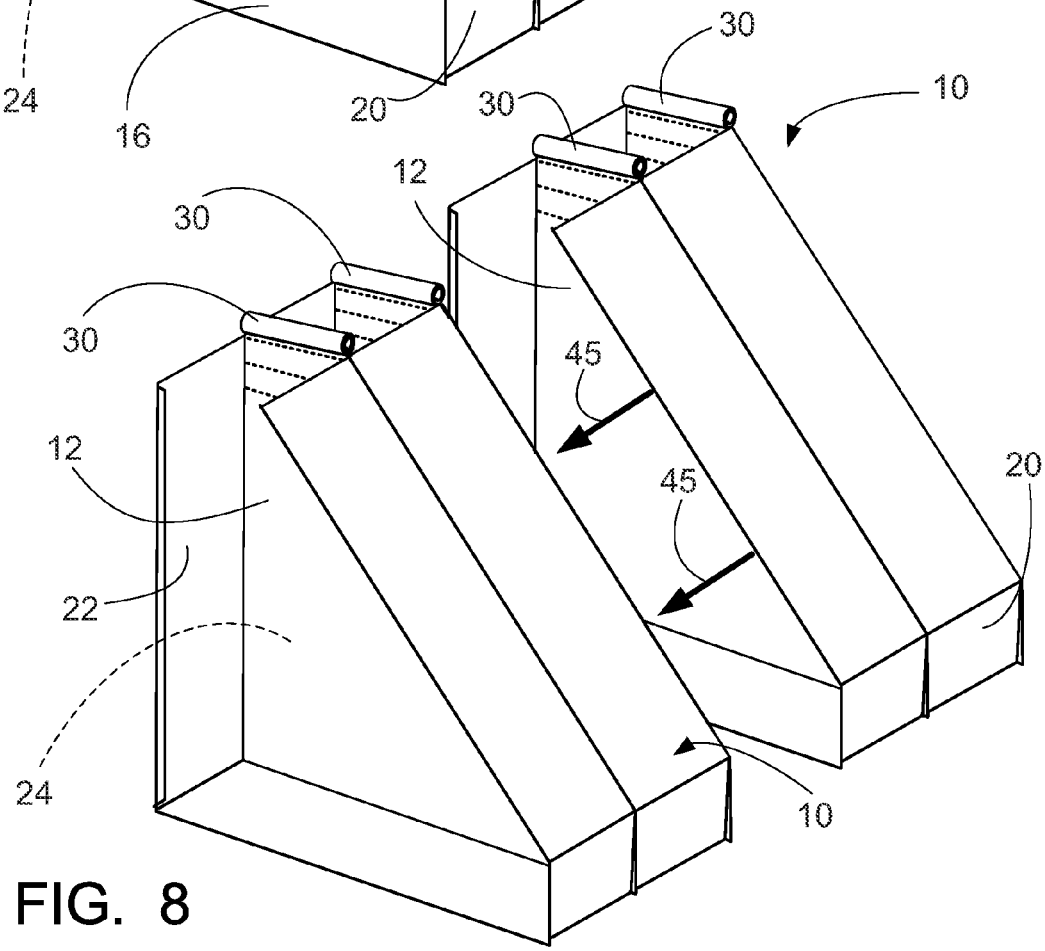
FIG. 8 illustrates linking of 20 sets together by sewing to form 100 foot (30 m) chain in the system of the present invention.

FIG. 8 illustrates the manner in which the plurality of chambers 10 are linked to one another, as seen by Arrows 45. Because each chamber 10 is secured to an adjacent chamber 10, along their side walls 12, it is seen that only one of the chambers 10 needs to have a completed side wall 12, so that when the first chamber 10, having both side walls 12 is secured to the adjacent chamber 10, one of the side walls 12 of the first chamber 10 can be shared with the adjacent chamber 10, thereby saving on fabric when construction the plurality of chambers into a continuous barrier wall. It is foreseen, for example, that because of the width of each completed chamber 10, twenty sets of chambers 10 sewn side by side would form a 100 foot (30 m) continuous, uninterrupted chain 50 of chambers 10 to define a barrier wall. FIG. 8 further illustrates the linking together of numerous sets by sewing them together to form any length of chain desired. It is acknowledged that the sewing patterns may be changed to accomplish the same end result. One such way would be to add each piece to a growing line rather than to make up individual groups and then sew them together.

Figure 9:
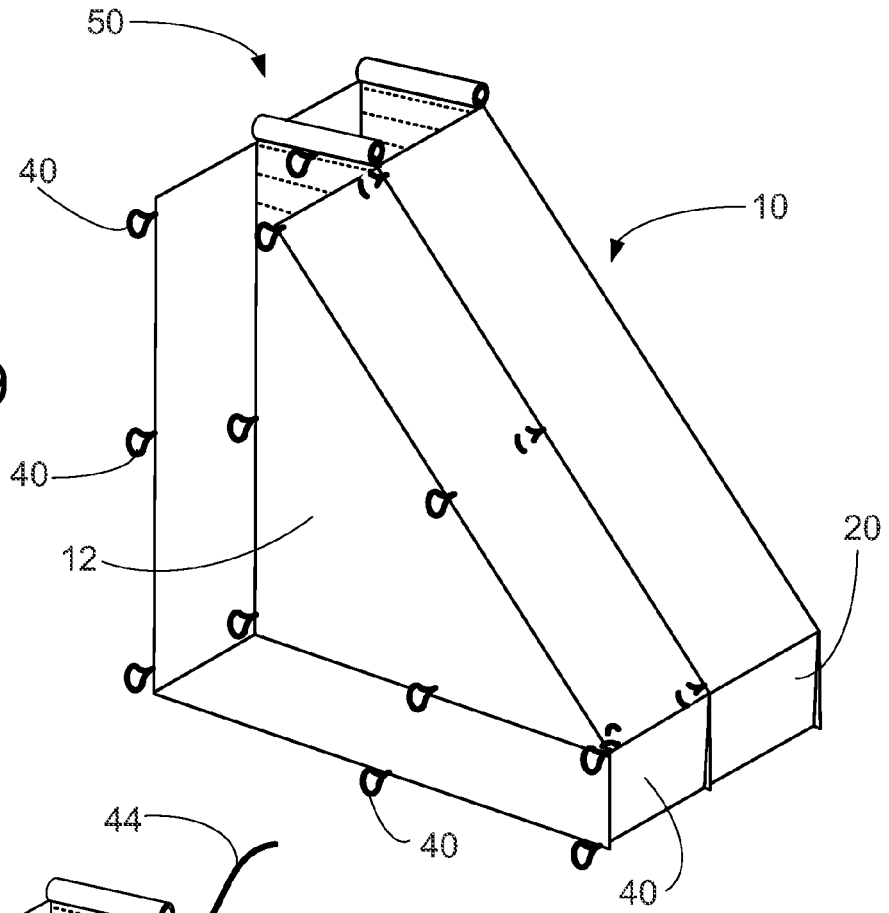
FIG. 9 illustrates preparing the connection chambers in the system of the present invention.
Figure 10:
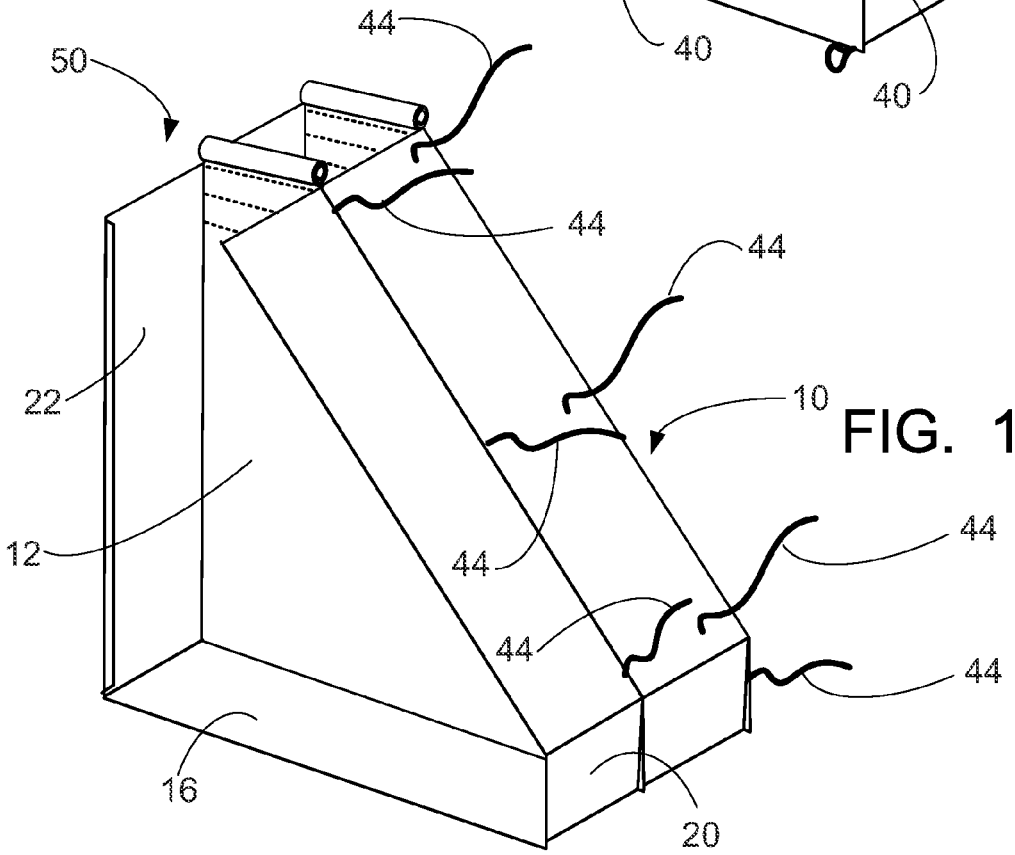
FIG. 10 illustrates adding ties to the first chamber of the next chain in the system of the present invention.

FIG. 9 illustrates the manner in which one chain 50 of chambers 10 are secured to one another. As illustrated, a chamber 10 at the end of the chain 50 has a plurality of loops 40, preferably 8 in number. In the preparation of the connection of chains 50 to one another, this is accomplished by attachment of the 8 loops 40 inside the seam 42 that attaches the front panel 18 to the side panels 12, of the end chamber 10 as seen in the Figure. The connection is completed in a step as seen in FIG. 10. This Figure illustrates the step of adding ties 44, preferably 16 in number, to the first chamber 10 of the next chain 50 of chambers 10. The sixteen ties 44 would tie into the loops 40 to anchor the unfilled chain 50 to a previously filled chain 50 of chambers 10.

Figures 11, 12:
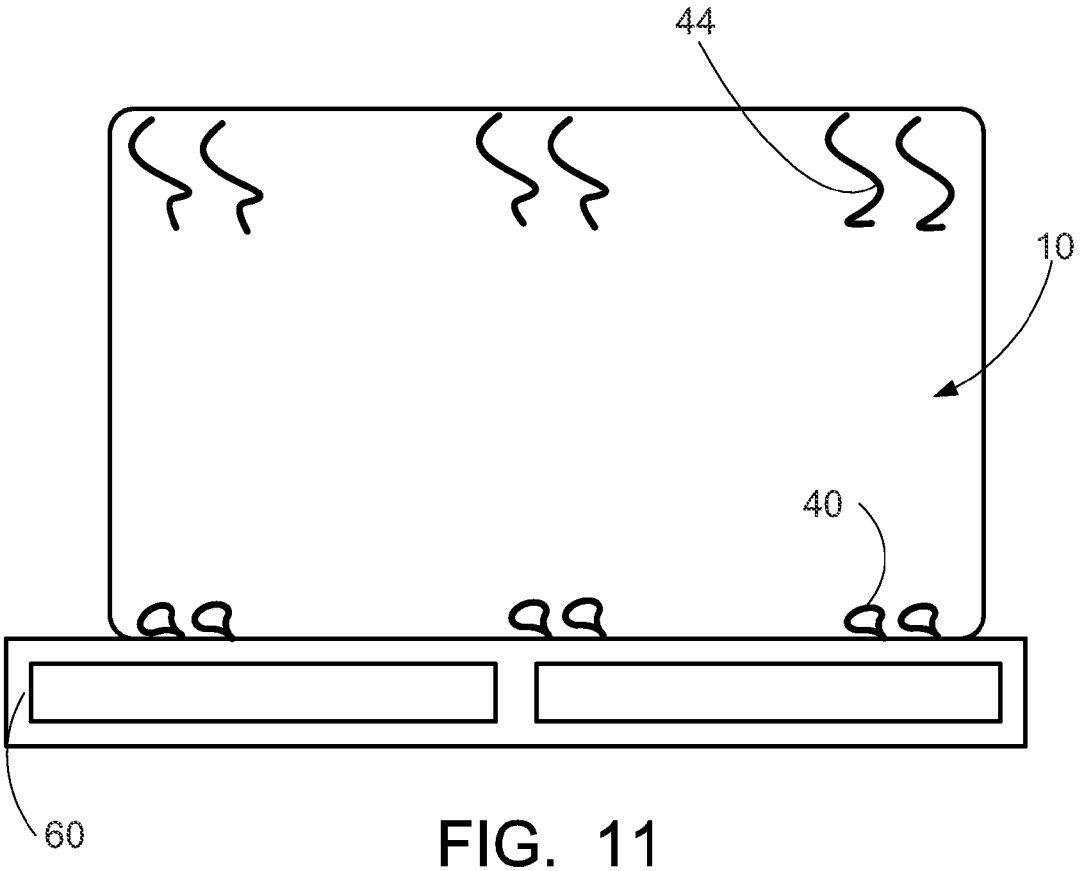
FIG. 11 illustrates packing completed chains in the system of the present invention.
FIG. 12 is a description of the final packing being done in the system of the present invention.

In FIG. 11, when a chain 50 of empty chambers 10 is complete, there is illustrated the packing of the completed chain 50 whereby each chain 50, in the preferred embodiment, should be packed with the front panel 18, having the loops 40 down on the pallet 60 first, and the chamber 10 with the ties 44 on top.

FIG. 12 discusses the final packing technique, where a cover bag is added, strapped to the pallet, and a tag is added indicating trap bag style that is six feet (1.8 m) in height.

Figure 13:
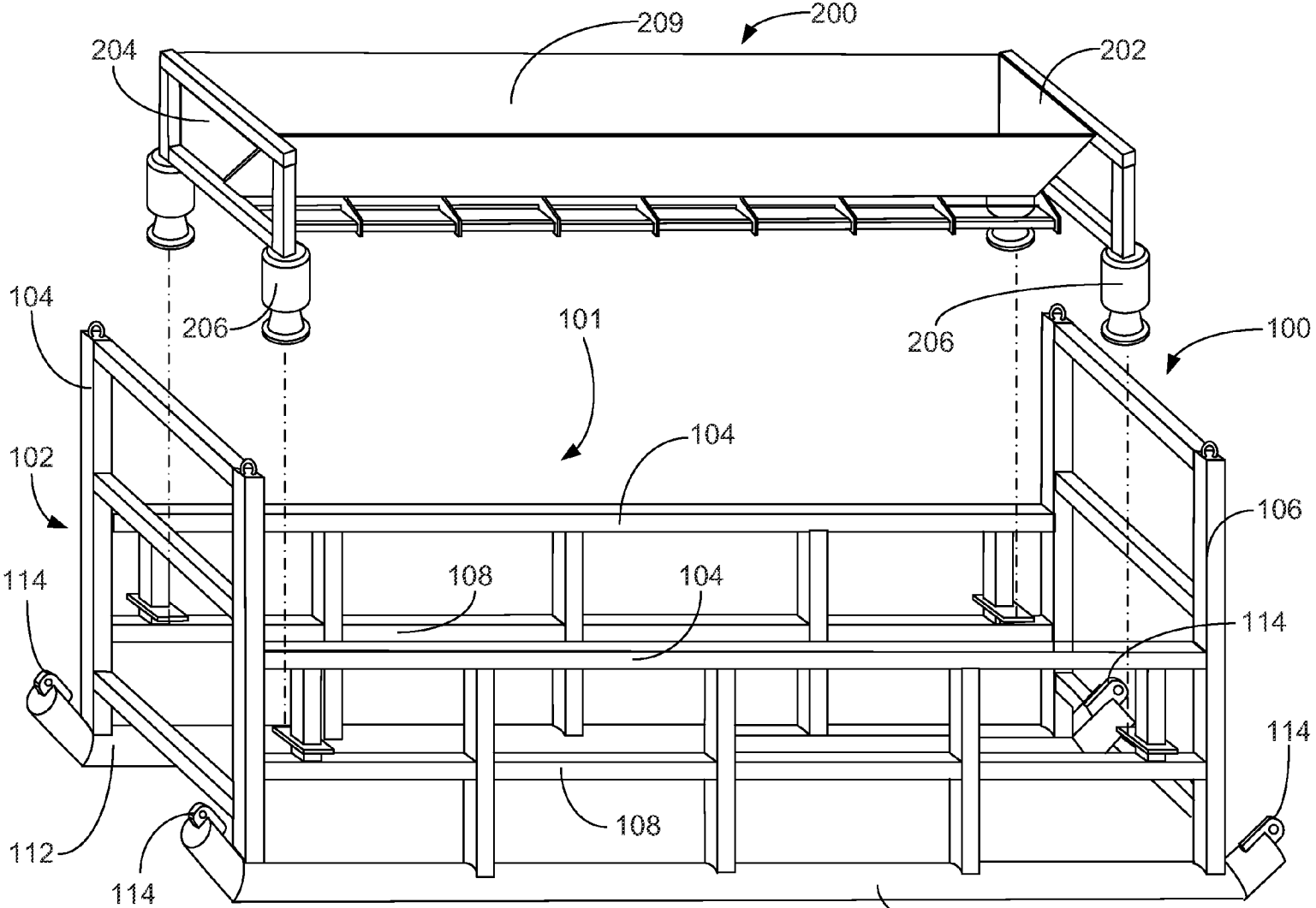
FIG. 13 illustrates an overall exploded view of the sled portion and hopper portion of the present invention.
Figure 14:
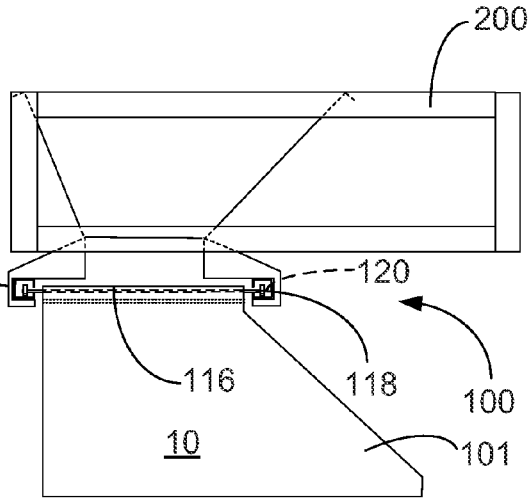
FIG. 14 illustrates a side view of the present invention with a filled bulk bag supported on the sled portion and below the hopper portion of the present invention.

Turning now to the machinery 100 which provides the mechanism for filling a plurality of the chambers 10, reference is made to FIGS. 13 through 18. As seen in overall, exploded view, the machinery 100 in general would be defined as comprising a first support sled portion 101 and a hopper portion 200 which will rest above sled portion 101 for the reasons as will be explained. In FIG. 13, the sled portion 101 comprises a generally rectangular frame 102, comprising a pair of upper frame members 104, running the length of sled 101, engaging a front end portion 104, a rear end portion 106. There are provided intermediate frame members 108 which engage intermediate upright frame members 110 to define the overall frame 102. Frame 102 rests upon a pair of skids 112, which would define the sled portion 101. The skids 112 which include padeyes 114 at their ends so that the sled 101 may be pulled in either direction during use of the sled 101.

Also illustrated in FIG. 13 is the hopper portion 200 of the machinery 100 for filling the chambers 10. Hopper 200 includes a first and second end portions 202, 204, which include feet members 206. There is provided a continuous funnel shaped hopper 200, set between the end portions 202, 204, which defines a material receiving portion 209 along the entire length of hopper 200 so that solid materials, such as sand, can be poured, as will be discussed further. As illustrated, hopper 200 would be the same dimensions in length and width as sled 101, and when in operation, would be resting on top of sled 101, as seen in FIGS. 16A and 16B.

As was discussed earlier, the various chambers 10 would be provided as a group of chambers 10 defining a length of the barrier system of the present invention. For purposes of a discussion of the relationship between chambers 10 and the sled 101 and hopper 200, first reference is made to FIGS. 14 and 15A and 15B. In those figures, there is seen a group of chambers 10 which are sewn together as a group, which are ready to be filled by the machinery 100. As illustrated, as was stated earlier in relation to FIGS. 1-12, each chamber is provided with a loop 40 along their two sides, so that a metal rod 116 can be threaded therethrough, with the ends 119 of the rod 116 extending past the edges of the loops 40. It should be noted that the end of each rod 116 includes a free rolling wheel 118, as will be explained.

Figure 15B:
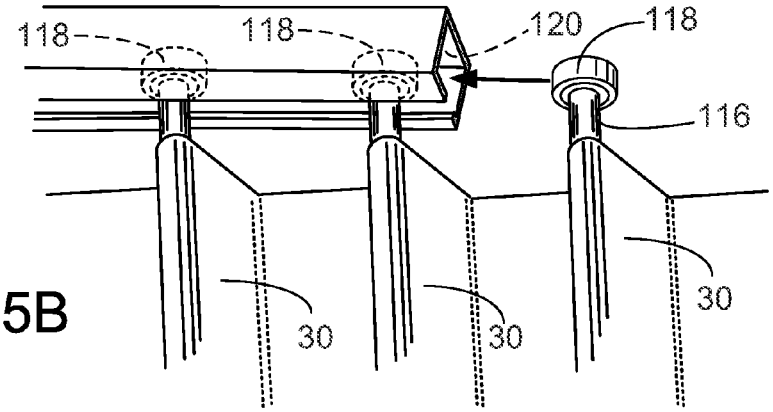
FIG. 15B illustrates the bags supported by the rods as they are being rolled onto the sled portion to be filled from the hopper portion of the present invention.
Figure 15A:
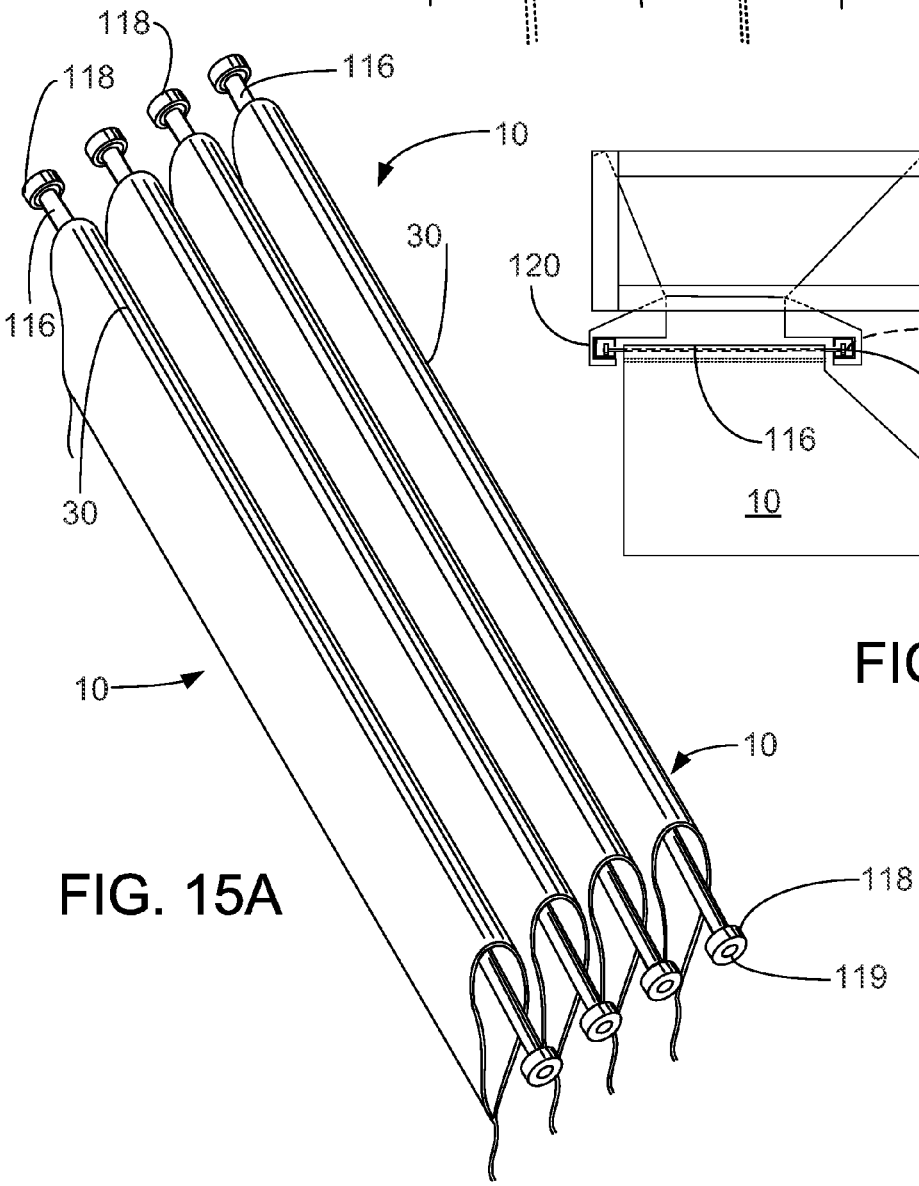

In FIG. 15A the chambers 10 are in a compact, unfilled mode, ready to be filled by machinery 100. Each loop 40 of each chamber 10 is provided a rod 140, and the ends of the rods 140, will be positioned within a continuous channel 120 which runs the length of the sled 101. The wheels 118 will engage the floor of each channel 120 and allow the bags to move with ease along the length of the sled 101 during the filling process. This positioning of the rods 118 can be seen in FIG. 15B, as the bags are unfurled from storage and positioned onto the sled 101. The sled 101, as illustrated, is currently capable of holding a plurality of seven chambers 10, all engaged as a single barrier unit, but each of which must be filled.

Figure 16A:
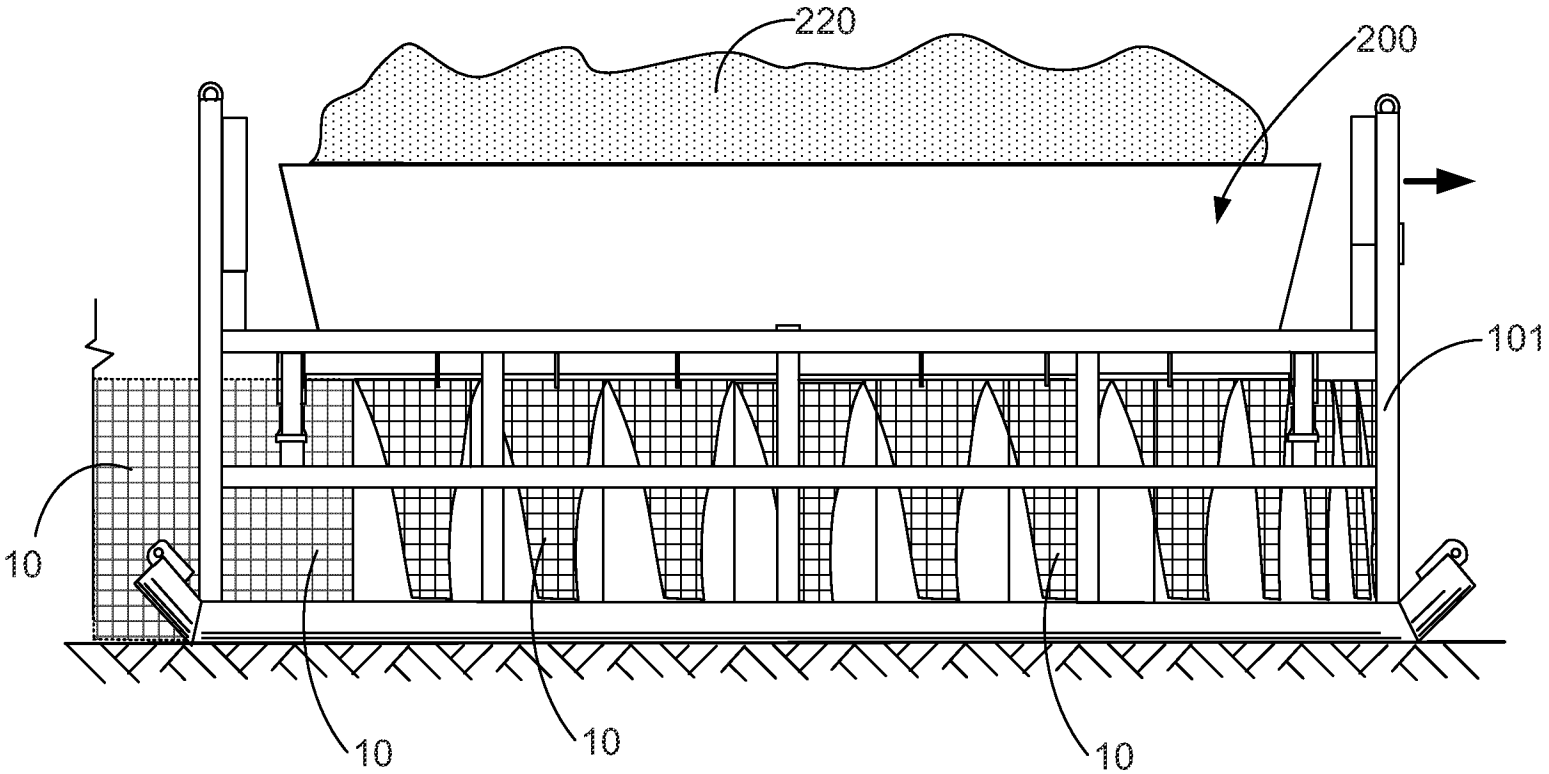
Figure 16B:
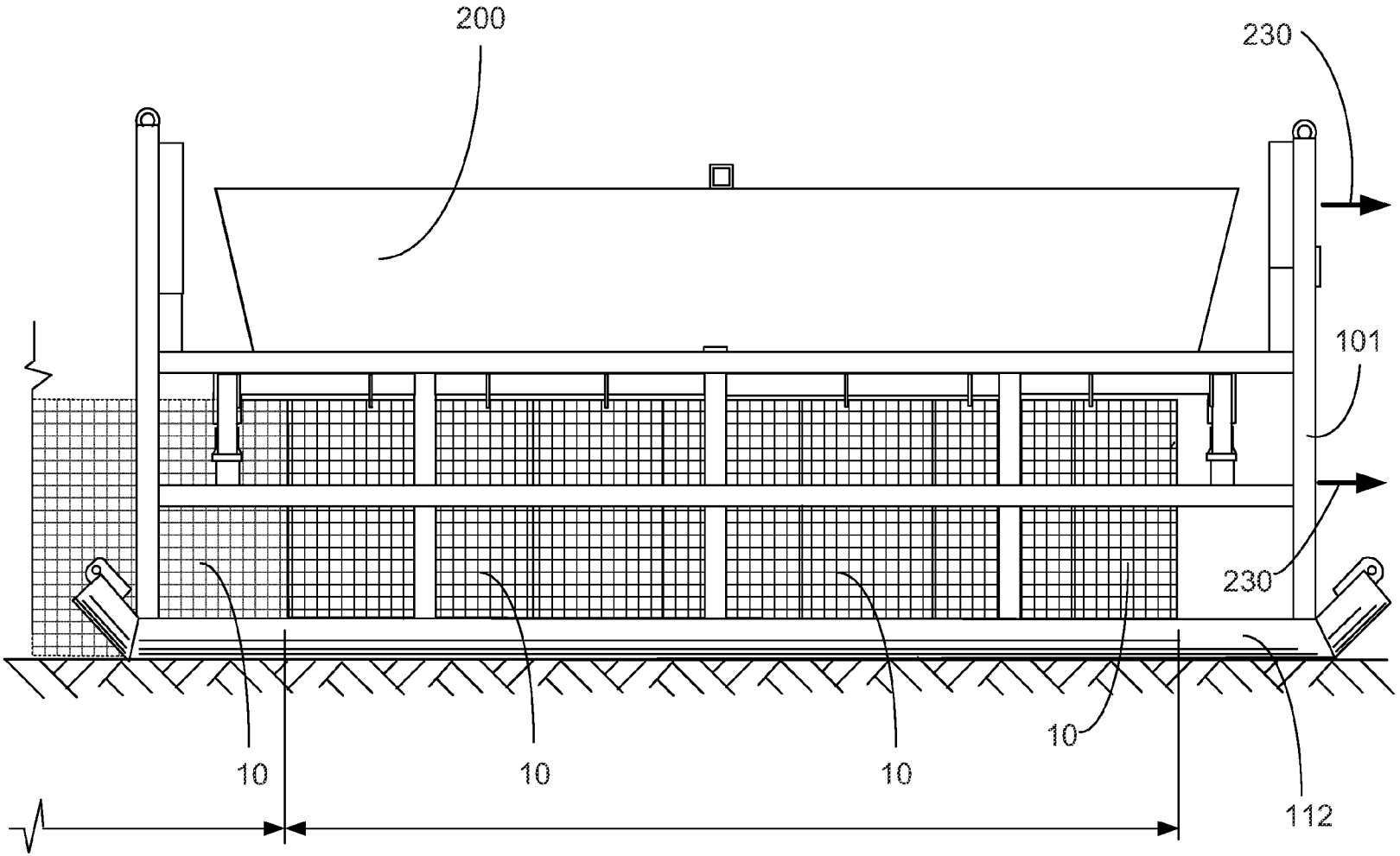
FIG. 16B illustrates the plurality of bags completely filled and still positioned on the sled portion of the present invention.
Figure 17:
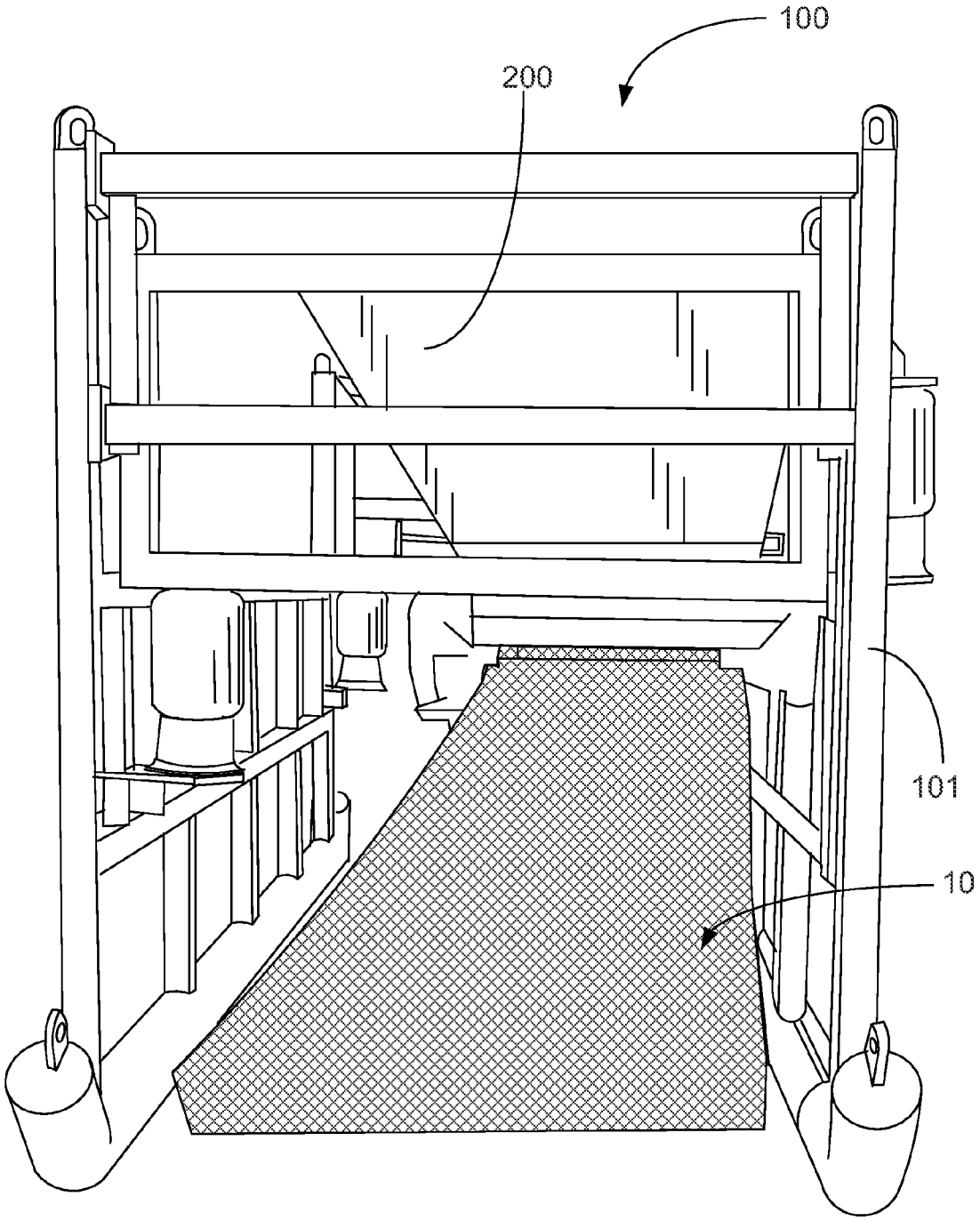
FIGS. 17 and 18 illustrate the use of the rods that are supporting the empty bulk bags within the frame of the machine used in the present invention.
Figure 18:
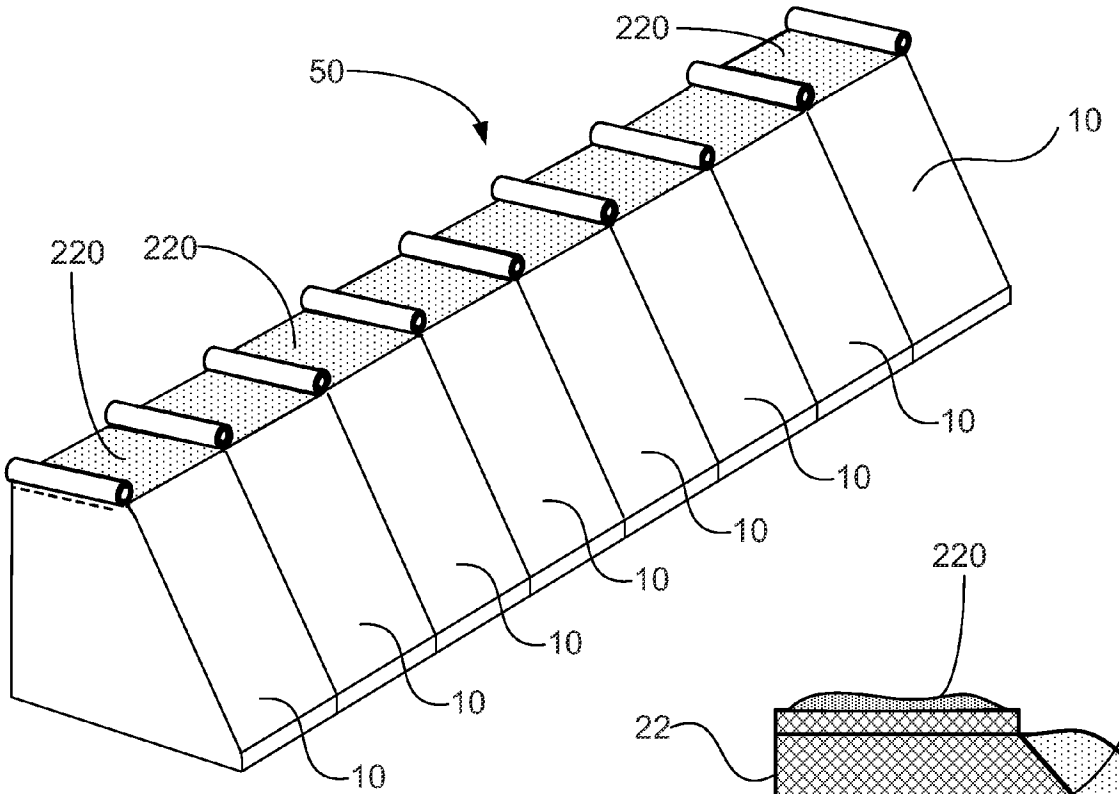

As seen in FIG. 16A, the series of seven interconnected chambers 10 have been rolled into position along sled 101, ready to be filled from hopper 200. Once the chambers are in position, the hopper 200, which is filled with solid material, such as sand 220, is opened, and the material fills all seven chambers 10 simultaneously, as seen in FIG. 16B. FIG. 17 illustrates in side view the outer most filled chamber 10 still positioned within sled 101.

Finally, after all chambers 10 are filled, the sled 101 is pulled away, and the filled chambers 10, as seen in FIG. 17, are set in place ready to be secured to the next section of filled chambers 10, to continue form the continuous barrier system.

Explaining the TrapBag® system further, the sled 101 is designed to move in a single direction along the area that is to be protected. Therefore there is a front a back portion to the sled 101. The back portion of the sled 101 is the loading portion. In this area the bags/chambers 10 are opened up for filling and sized to just reach the ground. Initially 4-5 chambers are open under the hopper 200 and the rest of the 100 foot (30 m) chain is waiting in an accordion position at the front of the sled 101 waiting to be opened and filled as the process proceeds.

To fill the barrier system, large earth moving equipment such as front end loaders, dump the filling materials into the hopper 200 trough on top of the sled 101. The filling materials immediately falls through the hopper 200 and into the open chambers 10 beneath the hopper 200. The filling process continues even after the chambers 10 are full until the hopper above is substantially full.

At that point the sled 101 is pulled from the front side by a tractor. As the tractor pulls the sled 101 forward, the filled bags stay in place which means the steel rods 116 roll off the rails on the back side.

Simultaneously, as the sled 101 is pulled forward, the back vertical wall of the sled 101 acts as a leveling and scraping device. It determines the final height of filler material in each bag and creates a wonderfully flat and level barrier wall.

Also simultaneously, as the sled 101 is pulled forward, new cells are pulled open from the accordion position to accommodate the widening distance between the filled cells and the unfilled cells.

Also simultaneously, the filler material that was on top of and above the cells 10 that were filled initially, that filler material is being scraped off the filled bags and gravity dropped into the newly opened cells! As long as there is filler material in the trough, the sled continues to be pulled forward.

Once the hopper 200 empties, there are three to five more cells (still connected to the previously filled cells) sitting under the hopper waiting for more filler materials. The heavy equipment now starts refilling the hopper 200 and the open cells beneath until the hopper is once again full. The sled 191 is pulled forward again leaving the filled cells in place on the ground and filling newly opened cells.

This is repeated over and over until the entire wall is in place, filled with materials to hold back rising water or mud slides, etc.

If the required wall is longer than the 100 foot (30 m) chain of cells, new chains must be added to the back of each accordion chain before the final cell is filled. This is done by enveloping the final cell with the open walls of the next chain and tying them together. The tying together can be done in numerous ways such as using simple nylon zip ties that are threaded through holes in the materials along the joints or by utilizing ties that can be attached during the manufacturing process. The main importance is that the end wall of the earlier chain is securely fastened to the first end wall of the new chain. This eliminates any difference in the amount of filler weight per foot (meter) at this point. The amount of protection remains constant even at the critical joint of each chain.

In summary, the system, which is referred to at times as The TrapBag®, comprises a series of identical chambers that are sewn together to make a continuous cellular wall. The system is constructed by building every other chamber completely, then connecting the completed chambers with a single main panel. A completed set of 34 chambers will be made up of 34 complete chambers and one (1) extra main panel. The number of cells in each chain is not critical to the invention. It is simply an amount chosen by the inventors for ease of handling and easy calculations.

The system is constructed in a series of steps that are all very similar to bulk bag production except the final stage of putting together the chain of bags. Each chamber will have two sleeves of fabric at the top opening of each chamber. These sleeves will be the total support of the chambers during the filling process. These sleeves will be added to each side panel prior to the production of the actual chamber. Dimensionally, the preferred horizontal length B will 2 feet (0.6 m) longer than the vertical height A. The Front Toe will preferably be 1 foot (0.3 m) tall. On each end of a completed chain will preferably be either a set of loops or an extra main panel with ties. This construction will allow chains to be tied together in the field to form a continuous barrier of any length. Should the length of barrier be less than an even number of completed chains, it is a simple effort to cut the remaining chain away while leaving the final chamber completely intact.

As stated earlier, the machine unit 100 which comprises a sled portion 101 having a frame members which define the substantially rectangular frame portion of the sled 101. The sled 101 further comprises a hopper 200 on the top of the sled 101 so that front end loading equipment is capable of dropping at least two cubic yards (1,529 liters) of dirt, sand, and stones into the hopper portion of the sled. The sled further includes an empty cellular wall section on the front side, with an empty cellular wall hung in a collapsed condition by using sleeves. Each sleeve 40 further comprises a steel rod 116 placed within each sleeve 40 that is longer than sleeve, with the steel bars extending across the width of the bottom of the hopper with wheels 118 resting on the two steel rails of the hopper 200 so that when sand or other material is poured into the bags they are substantially held upright until they are filled with material. Dimensionally, the opening on the hopper bottom is smaller than the open top of the cells to be filled. The track is positioned very close to the bottom of the hopper such that the angle of repose of the filling materials will not allow product to flow over and past the sides of the open cells. It is this feature that prevents any substantial loss of filling materials during the filling operation.

One of the keys to this success is the idea that these cells are all connected. The water cannot move a single cell without moving the entire line which then weighs many thousands of pounds (kg). The sand bags currently being used weigh 50 pounds (23 kg) or less and are not connected. If the flood can move a single bag, the water starts to flow and the hole in the protection automatically grows and grows pretty vigorously.

Further, as discussed earlier, there is viewed a plurality of rods 116 which are supported on the frame work of the sled 101 of the present invention when the bags are empty. As the rods 116 are slid along the length of the frame, the bags are moved to the open position where dirt or other material may be placed, it should be noted that there is a corner that is not sewn all the way to the corner. It would be fine if both sides were exactly the same shown long or short.

As illustrated, one would notice how the vertical is stitched up tight to the corner of the bag as the bags are supported by the rods as illustrated in that figure.

Returning to FIG. 18, there is shown a plurality of bags which are sewn together and which have been moved through the sled 101 and each bag filled with the material as was discussed earlier. This chain of bags as illustrate how the bags form a cohesive unit with having there been a flat side of the bag and an angulated side of the bag.

Figure 19:
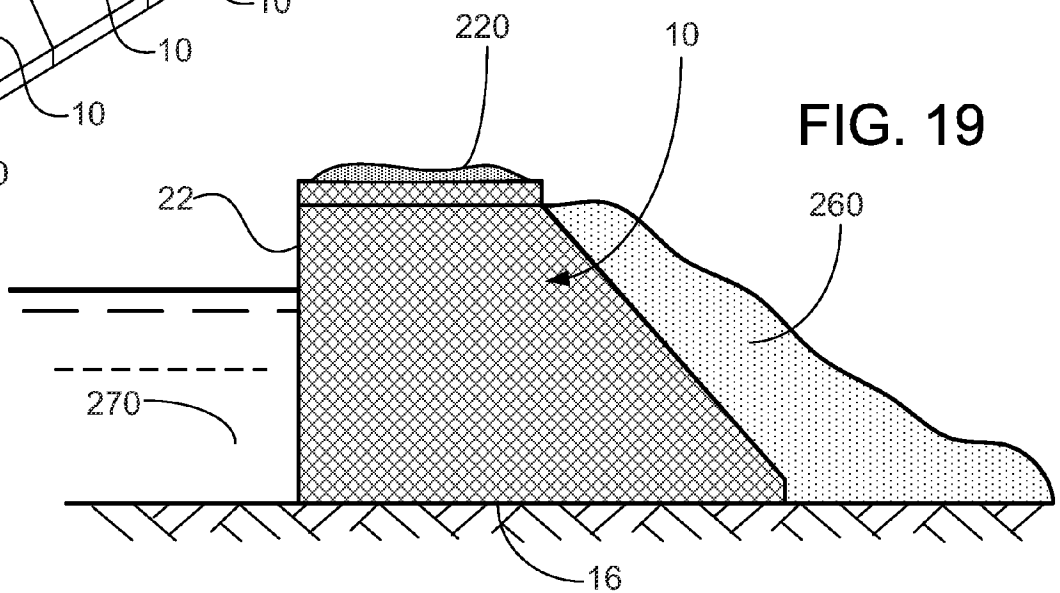
FIG. 19 illustrates the bulk bag system of the present invention in position to protect land from rising water.

In FIG. 19 there is illustrated the Trapbag System has been placed in position to form a barrier against rising water 270 against the system. To help support the system upright, there could be provided a layer of soil 260 to help the system remain in place against the force of the rising water 270.

Several components of bags have been linked together which then define a continuous barrier wall as seen in the various views in those figures. It is this barrier wall formed by the fill bags, wherein they would support and defend against rising water as would a man-made levee. However, these would not be placed in a permanent position but may be removed after the flooding has subsided.

Part Number Description

10 chambers
12, 14 sidewalls
16 floor portion
18 forward face
20 toe portion
22 rear wall
24 container space
26 upper end
28 open end
30 fabric channels
32 diagonal line
35 fabric
40 loops
42 seam
44 ties
45 arrows
50 chain
60 pallet
100 machinery
101 sled portion
102 rectangular frame
104 upper frame
108 frame members
110 upright frame members
112 skids
114 padeyes
116 rods
118 wheels
119 ends
120 channel
200 hopper portion
202 first end portion
204 second end portion
206 feet members
209 material receiving portion
220 sand
260 soil
270 rising water All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A non-self-standing cellular wall comprising woven fabrics that comprises:

a plurality of cells shaped by two parallel vertical side walls with a center side wall being common to adjoining cells;

an overall cell shape being pentagonal;

with one vertical rear wall determining an overall height of the cell;

one horizontal floor portion determining a bottom length of the cell;

a truncated toe portion opposite the vertical rear wall that is also vertical but is at least 50% shorter in height than the opposing vertical rear wall for enabling filling an entire cell with filler materials to a front of the truncated toe portion;

one upper end that is open and unobstructed so filler materials can be added; and one angled forward face wall connecting to the open upper end;

the width of each cell being variable but with a preferred width of 30 inches;

the cellular wall having fabric sleeves at the top of each parallel separating wall that are used to support the wall during the filling process; and such sleeves being designed to hold temporary support bars that maintain the cellular wall's weight during the filling process.

2. A method of constructing any desired length or height linear cellular chain for use as a protective wall system, made of flexible materials, comprising the following steps:

providing a first side wall shaped such that it will provide a specified shape to a vertical rear wall;

the specified shape shall have a vertical rear wall that will define the final height of each cell, a floor portion that is longer than the height of the vertical rear wall, a second vertical wall that defines a truncated toe portion that is sized to allow for a forward face wall that will slope upward to have at least a 45 degree angle up to an opening for filling that is defined by the top of the vertical rear wall and the top of the forward face wall;

providing a sleeve of similar flexible materials at the top of each side wall that are essentially the full length of the defined opening and tall enough to accept a support rod for filling;

providing a second side wall made of essentially the same flexible material that equals the length of the enclosed dimensions of a completed cell by sewing one edge of the vertical rear wall along the edge of the side wall, starting at the top of the vertical side wall and sewing around the entire perimeter, ending at the top of the forward face;

repeating the above steps by adding additional end panels and main panels until the desired length of chain is achieved.

3. A non-self-standing cellular wall comprising:

woven fabrics that further comprise at least multiple cells, each cell further comprising a pair of parallel vertical side walls, a floor portion, a rear wall, and a sloping forward face, terminating in a vertical toe portion at a front end and terminating at an open upper portion at a second end, to define a storage space within each cell, with a center side wall being common to adjoining cells; and fabric sleeves extending along the upper portion of each separating side wall for receiving temporary support bars through the sleeves to support the side walls of each cell while material is poured into the open top portion to fill the storage space and to prevent the sidewalls from sagging.

* * * * *